US006511414B1

(12) United States Patent
Hamsund

(10) Patent No.: US 6,511,414 B1
(45) Date of Patent: Jan. 28, 2003

(54) INFANT INCUBATOR

(76) Inventor: Torgeir Hamsund, Lybekkveien 48a, N 0385 Oslo (NO)

( * ) Notice: Subject to any disclaimer, the term of this patent is extended or adjusted under 35 U.S.C. 154(b) by 0 days.

(21) Appl. No.: 09/530,335

(22) PCT Filed: Oct. 28, 1998

(86) PCT No.: PCT/NO98/00320

§ 371 (c)(1),
(2), (4) Date: Jun. 5, 2000

(87) PCT Pub. No.: WO99/21526

PCT Pub. Date: May 6, 1999

(30) Foreign Application Priority Data

Oct. 29, 1997 (NO) ..... 974982

(51) Int. Cl.[7] ..... A61G 11/00
(52) U.S. Cl. ..... 600/22
(58) Field of Search ..... 600/21, 22; 5/603, 5/600

(56) References Cited

U.S. PATENT DOCUMENTS 3,158,150 A * 11/1964 Croasdaile ..... 600/22
4,846,783 A 7/1989 Koch et al. ..... 600/22
5,100,375 A 3/1992 Koch ..... 600/22
5,539,854 A 7/1996 Jones et al. ..... 392/403
5,797,833 A * 8/1998 Kobayashi et al. ..... 600/22
5,971,912 A * 10/1999 Honma et al. ..... 600/22

FOREIGN PATENT DOCUMENTS

EP 0 236 851 A2 9/1987 ..... A61G/11/00
EP 0 447 958 A1 9/1991 ..... A61G/11/00
EP 0687 458 A1 12/1995 ..... A61G/11/00

* cited by examiner

*Primary Examiner*—Kevin Shaver
*Assistant Examiner*—Brian Szmal
(74) *Attorney, Agent, or Firm*—Carter J. White; Howrey Simon Arnold & White LLP

(57) ABSTRACT

An incubator for premature or weakly infants having a base section which serves as a support for both the infant in the incubator chamber and a protective top section made of a substantially transparent material. The incubator chamber is surrounded by an inner and an outer shell. The temperature and humidity of the air in the incubator chamber is controlled by introducing conditioned air into the incubator chamber and withdrawing it between the inner and outer shells.

10 Claims, 4 Drawing Sheets

INFANT INCUBATOR

The present invention relates to an improved infant incubator.

The purpose of an infant incubator is to secure and improve the chances of survival of a premature or weakly infant. This is accomplished by keeping the infant in an environment which is warm, moist and contains sufficient oxygen. A premature infant has a low body weight, and thus a body temperature which is close to the ambient temperature. The premature infant is therefore very vulnerable, to temperature swings, and consequently major efforts have been made to develop incubators which maintain as constant a temperature as possible.

The incubators dominating today's market comprise a lower section housing equipment for adjusting the temperature and the composition of the gas delivered to the premature infant. Placed on this lower section is an upper section made of a transparent material, through which there are provided closable portholes to allow the premature infant to be cared for without removing the whole of the upper section. Inside the incubator, the infant lies on a mattress which forms the dividing line between the upper and the lower section. The gas in the incubator comprising air, possibly with the addition of extra oxygen and moisture, circulates up between the walls of the incubator and the mattress on one side, and down into a corresponding opening on the opposite side of the incubator. To improve the flow pattern of the gas, an inner wall is often provided in the upper section of the incubator, causing the gas to flow up and down between the outer shell and the inner wall in the upper section of the incubator. Means for heating, humidifying and circulating the air flow are provided in the lower section of the incubator. This means that a heating element and a fan are located in proximity to the premature infant. The heating'element and fan may be the source of some electromagnetic radiation, a radiation which at present is the subject of intense discussion with respect to whether it has any effects on health. In addition, and more importantly, a fan of this kind cannot be entirely noise-free and is thus the source of an acoustic nuisance for the tiny patient.

Moreover, when a porthole is opened in the upper section, the circulating air will draw the colder air of the surroundings with it into the incubator, which may cause the temperature in such an incubator to fall by about 2° C. when a door is open for more than 10 minutes. A temperature drop of this kind may at first seem to be insignificant, but is most unfortunate for the extraordinarily vulnerable premature infant who has little energy to burn and low heat capacity. The doors must be opened from time to time to care for and carry out test procedures on the premature infant. Moreover, it is desirable that the premature infant should not be completely isolated from the surroundings since, just as other infants, the premature infant needs body contact—even if nothing more than the touch of a friendly hand. The portholes in the incubator may therefore remain open for many periods of more than 10 minutes.

The object of the present invention is to provide an infant incubator where the aforementioned problems are obviated.

This is achieved according to the present invention by means of an incubator for a prematurely born or weakly infant comprising a base section which serves as a support for both the infant placed in the incubator and a protective top section or hood which is made of a substantially transparent material, wherein the base section houses means for causing air to circulate to the chamber enclosed by the base section and the top section, and means for adjusting the temperature, composition and humidity of the air, and ducts for the supply of air to the chamber and the outlet of air from the chamber respectively, and wherein the top section consists of an outer shell and an inner shell, which shells rest on the base section and wherein the inner shell is open at the top, and wherein portholes, preferably equipped with covers, are provided in the top section, wherein the incubator air supply ducts open into the chamber against and on the inside of the inner shell and the air outlet ducts run out between the inner and the outer shell.

In the present infant incubator, the air flows in on the inside of the inner shell in contrast to the previously known incubators. This ensures that the air circulates through the chamber in which the weakly neonate is lying and provides a constant adequate supply of oxygen-rich air to the infant.

Whilst in the incubator, the infant must be cared for, tests must often be taken and the infant also needs physical contact. In the present incubator, the problem of the incoming air drawing with it "cold" outside air into the chamber of the incubator is reduced or prevented.

The present invention will now be explained with the aid of the attached figures, wherein.

Figure 1:
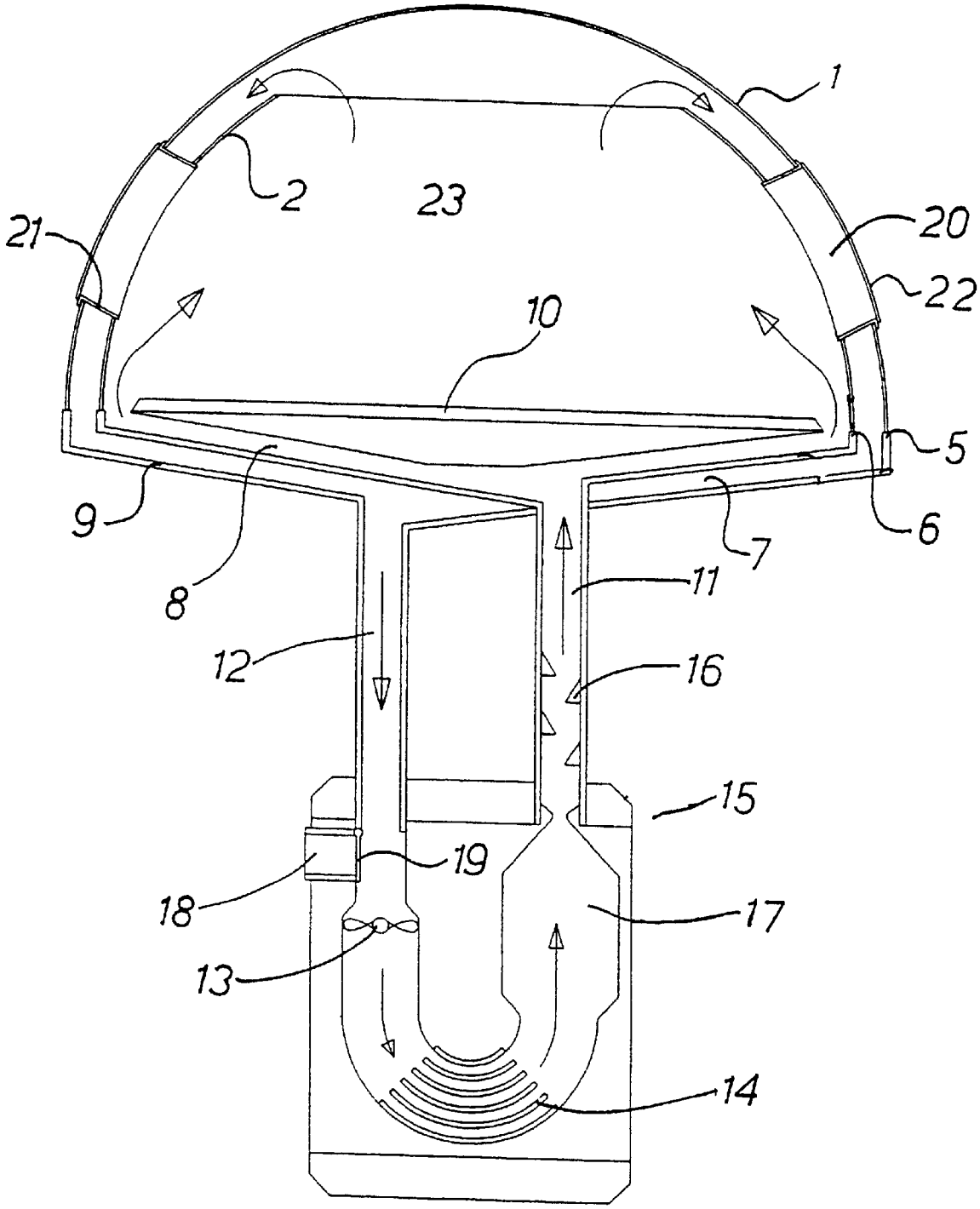
FIG. 1 is a sectional view through a preferred embodiment of the present infant incubator.
Figure 2:
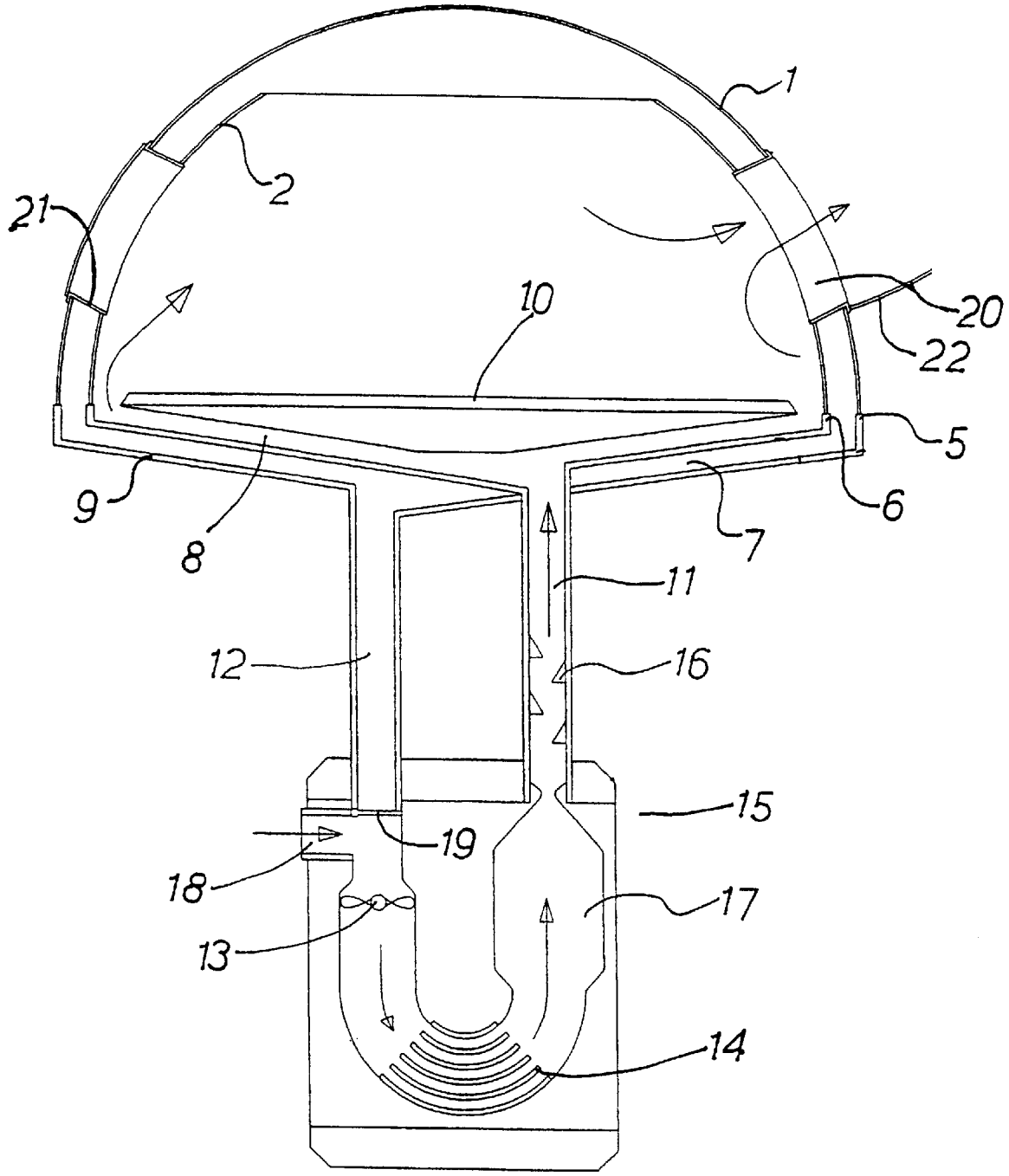
FIG. 2 is a similar sectional view through the present incubator, but where a porthole is open.
Figure 3:
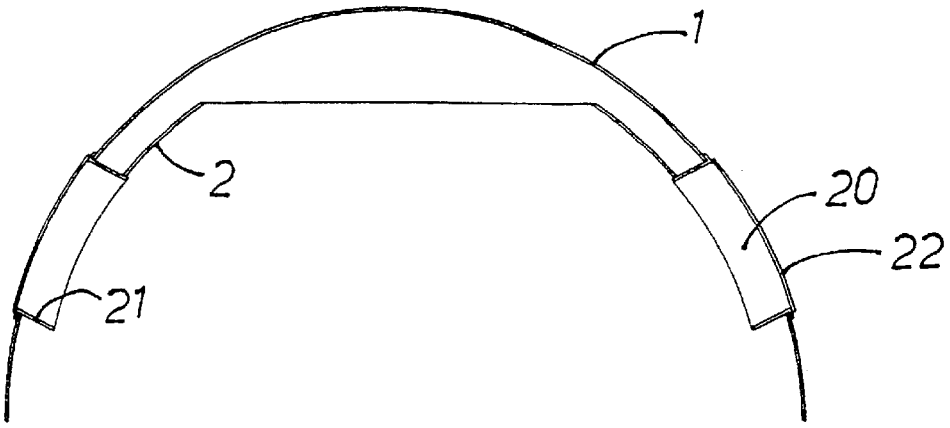
FIG. 3 is a sectional view through an alternative embodiment of the present incubator.
Figure 3:
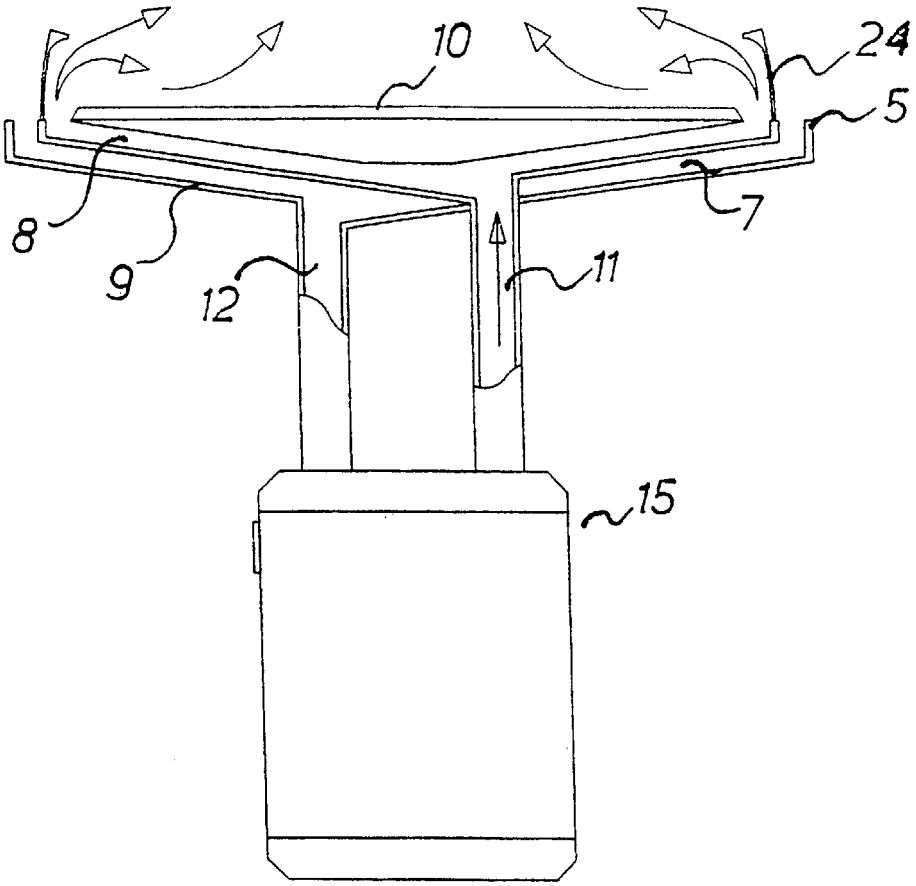
Figure 4:
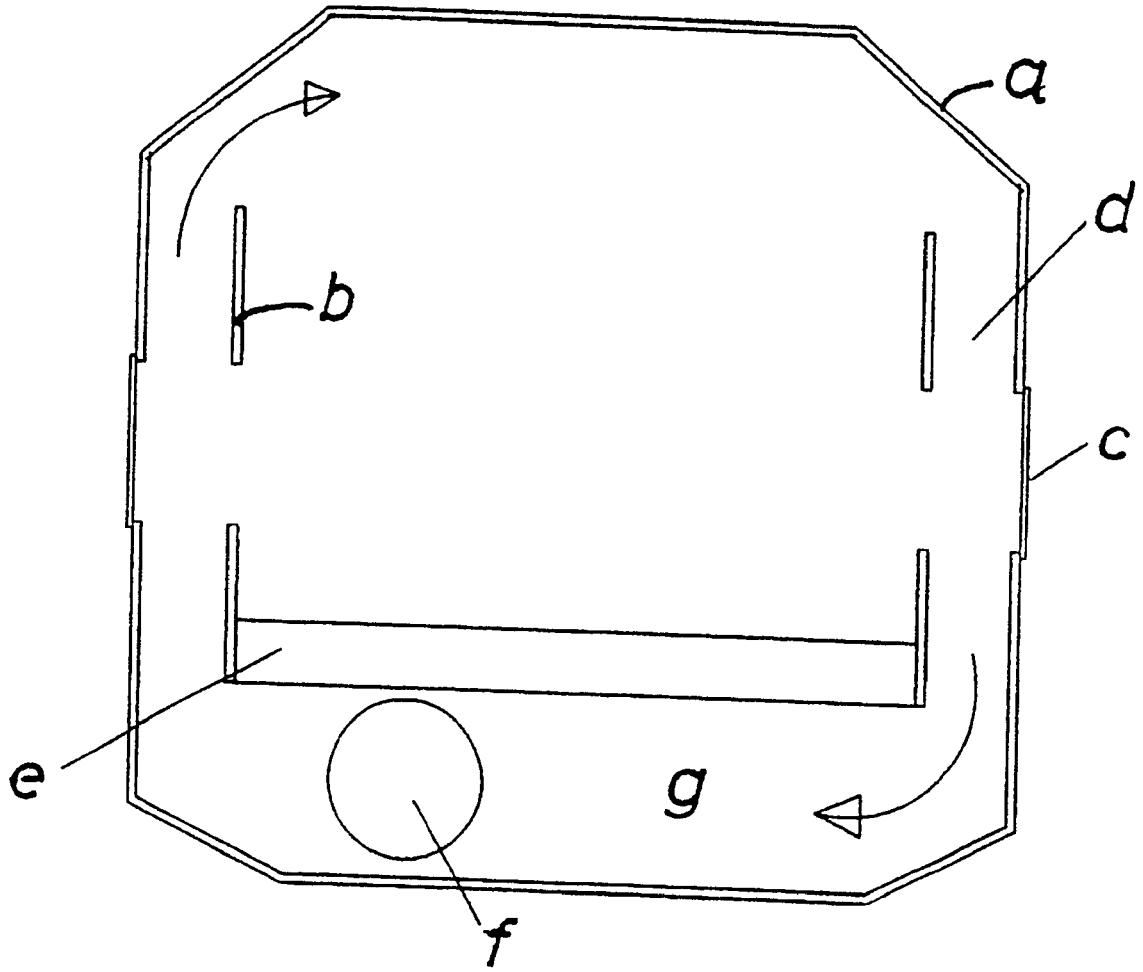
FIG. 4 is a longitudinal section through a conventional incubator.

FIGS. 1, 2 and 3 show two preferred embodiments of the incubator, whilst FIG. 4 is a sectional view through a conventional incubator which is surrounded by an outer shell a and wherein an inner shell b is provided in parts of the incubator. A fan f in a lower chamber g causes the air to circulate up between the inner and the outer shell on one side and down between the inner and the outer shell on the other side. Attending personnel and parents can gain access to the infant in the incubator through portholes is covered by cover c.

The present incubator, in the simplest, and preferred embodiment as shown in FIGS. 1 and 2, comprises a top section 1, 2 and a base section 9, 15. The top section 1, 2 comprises an outer hemispherical shield 1 in a transparent material and an inner hemispherical shell 2 cut open at the top, between which shells there is an air space. The outer shell 1 and inner shell 2 rest on respective seats 5, 6 on the base section 9, 15. The infant lies inside a chamber 23 defined by the top section 1, 2 and the base section 9, 15, and preferably lies on a bottom board 10 which either is soft in itself or on which a mattress is provided.

The portholes 20 in the top section 1, 2 allowing the infant to be cared for pass through both the outer shell 1 and the inner shell 2 and are connected by a collar 21. Additionally, the portholes 20 are normally closed by covers 22. The collar 21 fits closely against the portholes 20 in the outer 1 and the inner 2 shell respectively.

Air is supplied to the chamber 23 through air supply pipe 11 and duct 8 in the base section 9, 15, and flows out into the chamber 23 from the ducts 8 between the base section 9 and the bottom board 10, up along the edges of the bottom board 10 and on the inside of the inner shell 2. This thus ensures a constant adequate flow of fresh air to the infant lying in the incubator with a minimum through-flow of air. Moreover, the bottom board 10 and the mattress, if any, will be heated from below by the air flowing into the incubator.

When the incubator covers 22 are closed, the air flows up on the inside of the inner shell 2 and up into the top of the top section 1, 2 and is drawn out again through the space between the outer 1 and the inner 2 shell and down into an outlet duct 7 and then to the air outlet pipe 12 in the base section 9, 15.

When one or more of the covers 22 are opened, the incubator is opened to its surroundings and air can flow into the chamber 23 through the portholes 20. The very fact that the air flow closest to the infant, that is, the air on the inside of the inner shell 2, is rising, largely prevents the air closest to the infant from being mixed with cold and possibly contaminated air. The air entering the portholes 20 is conducted upwards and away from the infant and out between the outer 1 and the inner 2 shell.

To further ensure that the air flowing downwards between the shells 1, 2 does not flow into the chamber 23 through the portholes in the inner shell 2, a collar 21 is preferably provided which tightly connects the inner 2 and the outer 1 shell.

As shown in the figures, the base section is preferably divided into a supporting member 9 and a bottom member 15, wherein the bottom member 15, which may optionally be mounted on non-illustrated wheels, contains the equipment necessary for maintaining a flow of air which in turn maintains the desired environment in the incubator. In the illustrated embodiment, this equipment comprises a fan 13 for the circulation of air, and also means 14 for heating and humidifying the air. A supply duct 18 for the supply of fresh, optionally oxygen-enriched, air to the incubator is also preferably provided in connection with the bottom member. The supply duct 18 will supply air to replace any air which might leak out because the incubator is not completely airtight and also replace oxygen which is used by the infant in the incubator.

The supply duct 18 in the illustrated embodiment is connected to the air outlet pipe 12 counterflow of the fan 13. The air entering through the supply duct 18 is thus heated and humidity is introduced therein before it is passed into the chamber 23. The air entering the supply duct 18 is preferably filtered, in addition to the composition of the air being adjustable, before it is fed into the incubator.

A valve 19 is fitted at the point where the supply duct 18 enters the air outlet pipe 12. The valve 19 functions as a three-way valve which is adapted for respectively admitting and blocking the air flow through the air outlet pipe 12, whilst respectively closing and opening the supply duct 18.

It is preferable that the valve 19 should close the air outlet pipe 12 and open the supply duct 18 when one or more of the covers 22 are to be opened. The attending personnel can do this manually by manoeuvring the valve 19 into the desired position before the door is opened and back again after the door has been closed. It is most preferable that the valve 19 should be manoeuvred in response to the opening of one or more of the covers 22, for example, by means of a micro-switch in connection with the doors 22, or with the aid of sensors which trigger the manoeuvring of the valve 19, for example, owing to a change in pressure in the chamber 23. The incubator thus becomes a plenum chamber with a small overpressure in the chamber 23 relative to the surroundings, and this ensures that cold and possibly impure air is not drawn into the incubator through open portholes 20.

The bottom member 15 which contains the means for circulating, adjusting the composition of and heating the air which is to be circulated in the incubator chamber is preferably located close to or on the floor at a distance from the chamber 23 in which the infant is to lie. The bottom member 15 houses a fan 13 as well as means 14 for heating and humidifying the circulating air flow, thus reducing considerably the acoustic nuisance and also any electromagnetic radiation in the chamber 23. The fan 13 which causes circulation of the air can never be noiseless, and for this reason sound absorbers 16, may be provided, e.g., in the air supply pipe 11 and/or in an equalising chamber 17 in the base unit. The purpose of the equalising chamber 17, besides the. fact that the sound absorbers 16 may be placed there, is to ensure that all the circulating air is mixed and is as homogeneous as possible.

It may be preferable that the bottom member 15 be mounted on wheels, enabling the unit to be moved easily. The bottom member 15 and the supporting member 9 are connected to the air supply pipe 11 and the air outlet pipe 12 which are connected to inlet duct 8 and outlet duct 7 respectively in the supporting member 9.

The air supply pipe 11 and the air outlet pipe 12 may be telescopic, enabling the height of the supporting member 9 above the floor to be adjusted according to need. The pipes 11, 12 alone may form the only connection between the bottom member 15 and the supporting member 9, thereby providing the necessary rigidity, but it is preferable that the members 9, 15 should be connected by a non-illustrated supporting column which provides the necessary rigidity and adjustment facility.

Whilst an infant is in the incubator, it may be preferable that the infant be placed with a part of the body, such as the head, either higher or lower than the rest of the body. In conventional incubators, this is done by building up under the mattress at the one end. This in turn will give a larger space between the mattress and the walls of the incubator which means that articles may easily be lost under the mattress.

However, in the case of the present incubator, this problem can be solved by inserting a swivel in the pipes 11 and 12 and optionally also on the aforementioned, but non-illustrated supporting column. This swivel, which must be lockable at any angle of choice, is preferably located as high as possible in the pipes 11, 12 and the optional supporting column, and so as close to the supporting member 9 as possible. For example, the swivel may coincide with the junction between the pipes 11, 12 and the supporting member 9.

The bottom board 10 may be fixedly mounted on the supporting member 9. However, it is preferred that the bottom board 10 be capable of rotation to facilitate access to and care of the infant in the incubator, without having to open more portholes than absolutely necessary and without having to lift the infant unnecessarily. This possibility of rotating the bottom board 10, and thus the infant, is of great importance for best possible access to the infant during routine nursing and care. Normally, in its simple form, the incubator will have a bottom board 10 which can be rotated manually by the attending person inserting his hands into the openings and turning the bottom board 10 with his hands. If so desired, the incubator may be equipped with a locking device which prevents the bottom board from turning unintentionally, or with a motor or the like for rotating the bottom board 10 without having to open the incubator.

FIG. 3 shows an alternative embodiment of the present incubator. This embodiment is preferred in cases where it is desirable that the incubator for periods of time should be capable of being used without the dome-shaped outer shell 1. In principle, this incubator is like that illustrated in FIGS. 1 and 2, and when closed, i.e., when the outer shell is mounted, will be identical thereto in terms of function. The difference between the embodiment shown in FIGS. 1 and 2 and that shown in FIG. 3 is that the lowermost part of the inner shell 2 has been cut off and replaced with a ring 24 which is located on the supporting member 9 and which protects the infant against draughts from the side. When the incubator is closed, the ring 24 seals against the lower edge of the inner shell 2.

FIG. 3 also shows the flow pattern of the air flow in the open incubator. Certain hospitals prefer to use open incubators of this kind. However, the open incubator has its limitations which are overcome by this combination of open incubator which can readily be converted into a closed incubator.

The present incubator is shown with a preferred dome-shaped outer shell 1. A dome-shaped outer shell 1 means that there are no flat surfaces on which foreign bodies may be placed. Foreign bodies of various kinds will inevitably be placed on an incubator with a flat top, even though the instructions state that this must not be done. Foreign bodies, such as items of equipment belonging to doctors and nurses, must not be placed on the incubator top as this creates noise for the infant in the incubator, both when the items are put there and when they remain there and vibrate on the top. It will be difficult or impossible to use the top of the incubator as a storage space when the shell is dome-shaped.

The infant lying in the incubator will be disturbed by light. In a neonatal care unit with a plurality of incubators, there will be activity around the clock and it will be relatively light. This will prevent the infant from having the sleep he needs. The present incubator can therefore be equipped with an outer shell 1 of a material which allows control of light penetration. Such materials are known and are used inter alia in windows having adjustable light penetration and in welding goggles where light penetration can be adjusted electronically.

The invention has been described for an incubator consisting of a bottom member 15 for each unit. However, it is also conceivable that a bottom member 15 may be connected to two or more incubator units comprising the supporting member 9, bottom board 10 and the top section 1, 2.

What is claimed is:

1. An incubator for premature or weakly infants comprising a base section (9, 15) which serves as a support for both the infant in the incubator and a protective top section (1, 2) which is made of a substantially transparent material, wherein the base section (9, 15) houses means for the circulation of air (13) to the chamber (23) enclosed by the base section (9, 15) and the top section (1, 2), and means (14, 17) for adjusting the temperature, composition and humidity of the air, and also ducts (7, 12, 8, 11) for the supply of air to the chamber (23) and the outlet of air from the chamber (23) respectively, and wherein the top section consists of an outer shell (1) and an inner shell (2), which shells (1, 2) rest on the base section (9, 15) and wherein the inner shell (2) is open at the top, and wherein portholes (20), preferably equipped with covers (22), are provided in the top section (1, 2), characterised in that the ducts (8) for the supply of air to the incubator open into the chamber (23) against and on the inside of the inner shell (2) and the ducts (7) for the outlet of air run out between the inner (2) and the outer (1) shell.

2. An incubator according to claim 1, characterised in that the portholes (20) pass through both the inner and the outer shell (1, 2) and that the shells (1, 2) are connected in the portholes (20).

3. An incubator according to claim 2, characterised in that the shells in the portholes (20) are connected by means of collars (21) which are closely fitted in the portholes in the inner and the outer shell (1, 2) respectively.

4. An incubator for infants comprising a base section including:

a support for the infant in the incubator;

means for circulating air;

means for adjusting the temperature, composition and humidity of the air within said base section being in fluid communication with said means for circulating air;

air inlet ducts in fluid communication with the means for adjusting the temperature, composition and humidity of the air; and, air outlet ducts in fluid communication with said means for circulation of air;

a protective Top section which is made of a substantially transparent material, wherein the top section includes an outer shell and an inner shell positioned to form an annular chamber between the outer shell and inner shell; wherein the inner shell has an opening at the top to provide fluid communication between the incubator chamber and the annular chamber formed by the inner shell and outer shell;

wherein the base section and the top section are designed such that the top section rests on the base section so as to form an incubator chamber, and wherein the air inlet ducts supply air directly to the incubator chamber, and wherein the annular chamber formed by the inner and outer shell is in fluid communication with both the incubation chamber and the outlet ducts of the base and wherein the air directly supplied to the incubator chamber flows upwardly from air inlet ducts in the base through the incubation chamber to the inner shell opening at the top and is drawn out through the space between the inner and outer shells and down into the outlet duct.

5. The incubator of claim 4, further comprising one or more porthole wherein said porthole passes through both the inner shell and the outer shell.

6. The incubator of claim 4, further comprising one or more porthole which is defined by a collar which is closely fitted to the inner and the outer shell, wherein said porthole passes through both the inner shell and the outer shell.

7. The incubator of claim 4 further comprising means which allow the temporary closure of the outlet ducts and at the same time temporary admission of the supply of air from a supply duct.

8. The incubator of claim 7, wherein the means for closure of the outlet ducts and admission of the supply of air from the supply duct are arranged to close the outlet ducts and admit the supply of air from supply duct when one or more of the portholes are open.

9. The incubator of claim 4, wherein the base section includes an air treatment unit containing the means for the circulation of air and the means for adjusting the temperature, composition and humidity of the air, and a supporting member which forms a base for the top section, wherein the air treatment unit and the supporting member are connected to one another via pipes or tubes.

10. An incubator for premature or weakly infants comprising a base section including:

a bottom board for supporting the infant in the incubator;

means for circulating air, said means for circulating air having a supply side and a demand side;

means for adjusting the temperature, composition and humidity of the air in fluid communication with the supply side of said means for circulating air;

one or more air inlet ducts in fluid communication with the means for adjusting the temperature, composition and humidity of the air; and one or more air outlet ducts in fluid communication with the demand side of the X means for circulating air;

a hemispherical top section which is made of a substantially transparent material, said hemispherical top section including an outer shell and an inner shell positioned to form an air space between the outer shell and inner shell and wherein the top section is designed such that the top section rests on the base section so as to form an incubator chamber;

an opening at the top of the inner shell, wherein the opening provides fluid communication between the incubator chamber and the air space formed by the inner shell and outer shell and one or more porthole which is defined by a collar which is closely fitted to the inner and the outer shell, wherein said porthole passes through both the inner shell and the outer shell and wherein said porthole provide a means for accessing the incubation chamber without having to move the top section;

wherein the air inlet ducts of the base section supply air to the incubator chamber; and wherein the air supplied to the incubation chamber flows out the opening at the top of the inner shell into the air space which is in fluid communication with the outlet ducts of the base and thus provide for the flow of air from within the incubator chamber out the opening at the top of the inner shell, through the air space to the outlet ducts of the base.

* * * * *